US010099757B2

(12) United States Patent
Strong et al.

(10) Patent No.: US 10,099,757 B2
(45) Date of Patent: Oct. 16, 2018

(54) RESCUE DEVICE

(71) Applicant: Reflex Marine Ltd., Truro (GB)

(72) Inventors: Philip Anton Strong, Broadclsyt (GB); Sergio De La Parra Pérez-Gavilán, Barcelona (ES); Rubén Beldé, Barcelona (ES)

(73) Assignee: Reflex Marine Ltd., Truro (GB)

( * ) Notice: Subject to any disclaimer, the term of this patent is extended or adjusted under 35 U.S.C. 154(b) by 0 days.

(21) Appl. No.: 15/393,544

(22) Filed: Dec. 29, 2016

(65) Prior Publication Data

US 2017/0183067 A1 Jun. 29, 2017

(30) Foreign Application Priority Data

Dec. 29, 2015 (EP) ..... 15382674

(51) Int. Cl.

| | |
|---|---|
| ***B63C 9/02*** | (2006.01) |
| ***B63C 9/26*** | (2006.01) |
| ***B63C 9/28*** | (2006.01) |
| ***A62B 1/02*** | (2006.01) |
| ***B63B 27/30*** | (2006.01) |
| ***B63B 23/38*** | (2006.01) |

(52) U.S. Cl.

CPC ..... *B63C 9/02* (2013.01); *A62B 1/02* (2013.01); *B63B 23/38* (2013.01); *B63B 27/30* (2013.01); *B63C 9/26* (2013.01); *B63C 9/28* (2013.01)

(58) Field of Classification Search

CPC ..... B63B 27/00; B63B 27/10; B63B 38/00; B63B 27/14; B66C 13/00; B66C 13/02; B63C 9/00; B63C 9/02; B63C 9/26; B63C 9/28

USPC ..... 441/87, 80

See application file for complete search history.

(56) References Cited

U.S. PATENT DOCUMENTS

| | | | | |
|---|---|---|---|---|
| 5,283,916 A * | 2/1994 | Haro | B63C 9/04 | 441/87 |
| 5,713,710 A | 2/1998 | Strong et al. | | |
| 8,439,622 B2 * | 5/2013 | Strong | B63B 27/16 | 114/363 |

* cited by examiner

*Primary Examiner* — Lars A Olson

(74) *Attorney, Agent, or Firm* — Schwegman Lundberg & Woessner, P.A.

(57) ABSTRACT

Rescue device comprising a base; a plurality of protective panels, a plurality of protective panels and hand gripping elements. At least one protective panel has a shell shape with a main body, at least a top protrusion and side protrusions, such that a protective space is formed, the protective space being suitable for a person to be housed in, such that the main body and the at least one side protrusion are suitable for protecting the protective space from an impact coming from directions parallel to the base and comprised in a range wider than 200°, and the top protrusion is suitable for protecting the protective space from an impact coming from a direction perpendicular to the base.

12 Claims, 3 Drawing Sheets

RESCUE DEVICE

CLAIM OF PRIORITY

This application claims the benefit of priority of European Patent Application No. EP15382674.8, filed on Dec. 29, 2015, the benefit of priority of which is claimed hereby, and which is incorporated by reference herein in its entirety.

TECHNICAL FIELD OF THE INVENTION

The present invention is related to the field of rescue devices, to rescue people offshore.

BACKGROUND OF THE INVENTION

In the field of transfer devices, there are several devices that provide the possibility of moving people from one place to another, by means of a crane or davit.

The most typical devices are the basket-type devices. Several options can be found in this kind of devices. The most commonly known is the "Billy Pugh" collapsible device, which is a rope basket with a solid base. This is a basic choice with limited safety features, as people to be transferred are just standing and need to hold on to the device, with no security attachments, no ergonomic positioning nor any protection against external impacts.

Other devices, such as those described in documents U.S. Pat. No. 5,713,710, describe improved devices adapted to transfer objects which can be secured or even a seating assembly to provide additional comfort and useful position for people who are being transferred.

Nevertheless, these devices provide limited protection during the transfer, which may compromise safety in challenging environments such as harsh weather areas.

SUMMARY OF THE INVENTION

The present invention provides the rescue device according to claim 1 as an alternative solution to the aforementioned problem. All the features described in this specification, including the claims, description and drawings, can be combined in any way, except for the cases of mutually exclusive features. The dependent claims define preferred embodiments of the invention.

According to a first aspect, the invention provides a rescue device comprising a base;

a plurality of protective panels, at least one protective panel having a shell shape with a main body, at least a top protrusion and at least one side protrusion, such that a protective space is formed, the protective space being suitable for a person to be housed in, such that the main body and the at least one side protrusion are suitable for protecting the protective space from an impact coming from directions parallel to the base, and the top protrusion is suitable for protecting the protective space from an impact coming from a direction perpendicular to the base; and hand gripping elements.

The main advantage of this rescue device is that it allows a passenger to be housed or positioned inside the protective space defined by a protective panel, thus being protected from impacts coming from outside the rescue device, mainly due to relative motions of the rescue device and environment, the obstructions within the landing area, but also due to waves or objects contained in the sea. The shell shape refers to the protective panel defining a concave protective space which is substantially limited by the inner surfaces of the main body and the top and side protrusions and a surface comprising the sides of the side protrusions and comprises straight lines parallel to the base that join points from the border of one side protrusion and the border of the other side protrusion. The inner surfaces are the surfaces intended to be faced towards the protective space.

In a particular embodiment, the main body and the at least one side protrusion are suitable for protecting the protective space from an impact coming from directions parallel to the base comprised in a range wider than 200°, preferably wider than 270°.

This rescue device is suitable for transferring people and/or personal equipment from a first location to a second location, defining inner space between the protective panels.

In a particular embodiment, the rescue device further comprises a pair of string elements associated to each protective panel, each string element being attached to the base and to another point of the rescue device, in such a way that the distance between each string element of the pair of string elements is preferably lower than 1 m and the distance between one string element and the associated protective panel is preferably comprised between 10 cm and 60 cm. In a particular embodiment, the pair of string elements is substantially perpendicular to the base.

In a particular embodiment the distance between each string element of the pair of string elements is preferably comprised between 25 and 30 cm.

Advantageously, the distance between each string element of the pair of string elements allows the passengers to pass between them, and the distance between one string element and the associated protective panel allows the passengers to pass their arms around the string elements.

In the context of this application, it will be understood that the terms string, cord of rope elements refer to elongated tensile elements, which are adapted to serve as retaining elements for a person using the rescue device. In a particular embodiment, string elements are ropes.

This rescue device provides means for retention of passengers in a standing position.

In a particular embodiment, each string element is attached to the base and to a protective panel.

In a particular embodiment, the rescue device further comprises an outer structure comprising bars. In a particular embodiment, each string element is attached to the base and to a bar.

In a particular embodiment, the rescue device further comprises lifting means having a structural wire or chain with a cord made of an elastomer material.

These lifting means are suitable for providing mitigation of shock on lifting and landing the rescue device.

In a particular embodiment, the base has a polygonal shape.

In a particular embodiment, at least one protective panel comprises seating means.

In a particular embodiment, at least one protective panel comprises shock absorbing means suitable for absorbing the energy of an impact. Advantageously, the shock absorbing means will absorb vertical and/or lateral impacts, depending on the disposition of the absorbing means in the top and/or side protrusions.

In a particular embodiment, at least one protective panel comprises buoyancy means.

DESCRIPTION OF THE DRAWINGS

These and other characteristics and advantages of the invention will be clearly understood in view of the detailed description of the invention and further in view of the preferred embodiments of the invention, with reference to the drawings. Preferred embodiments are given just as examples and are not intended to limit the scope of the present invention.

DETAILED DESCRIPTION OF THE INVENTION

Having outlined the object of the invention, specific non-limitative embodiments are described hereinafter.

Figure 1:
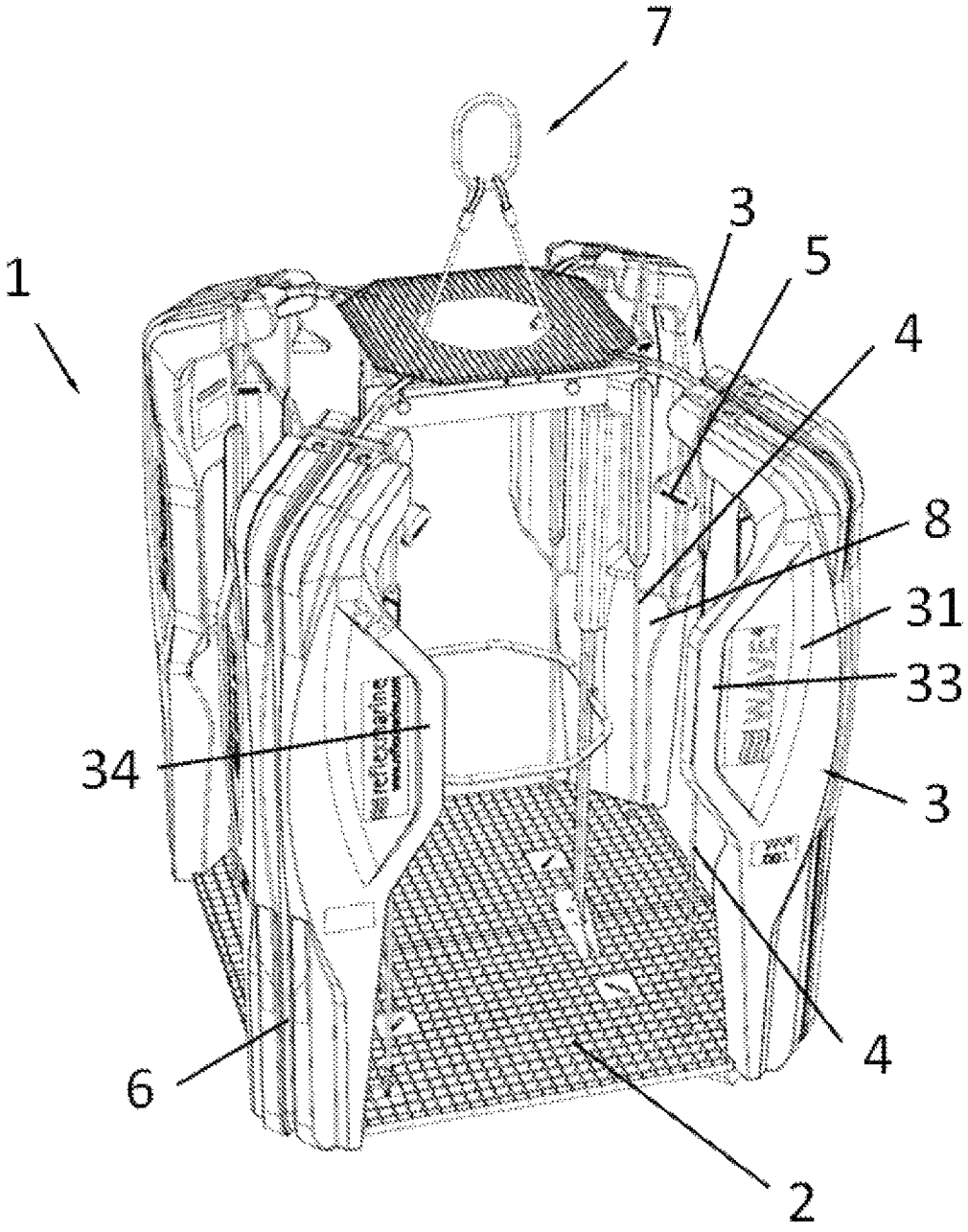
FIG. 1 This figure shows a perspective view of a first embodiment of a rescue device according to the invention.

FIG. 1 shows a perspective view of a particular embodiment of a rescue device (1) according to the invention. This rescue device (1) comprises a base (2) having a polygonal shape;

a plurality of protective panels (3), each protective panel (3) having a shell shape with a main body (31), a top protrusion (32) and side protrusions (33, 34), such that a protective space is formed, the protective space being suitable for a person to be housed in, such that the main body (31) and the at least one side protrusion (33, 34) are suitable for protecting the protective space from an impact coming from directions parallel to the base (2) and comprised in a range wider than 200°, and the top protrusion (32) is suitable for protecting the protective space from an impact coming from a direction perpendicular to the base (2);

a pair of string elements (4) associated to each protective panel (3), each string element (4) being attached to the base (2) and to another point of the rescue device (1), which in this case is the top protrusion (32) of the protective panel (3), in such a way that the distance between each string element (4) of the pair of string elements is lower than 1 m and the distance between one string element (4) and the associated protective panel is comprised between 10 cm and 60 cm;

hand gripping elements (5); and an outer structure comprising bars (6).

In this embodiment, each string element (4) is attached to the base (2) and to the top protrusion (32) of the corresponding protective panel (3). However, in other embodiments, the string elements are attached to the base (2) and to a bar (6).

In this embodiment, string elements (4) are ropes. However, nylon strings or straps are used in other embodiments. The main aim of these string elements (4) is helping ensuring that a person using the device (1) stays within the protective space, by providing a flexible restraining means, in such a way that entering the protective space and exiting it turn out to be easy and quick actions. The string elements (4) act like a bow string or like a guitar string, providing the elastic properties necessary for a person to enter and exit the protective space in a quick way, but providing sufficient restraining for if the person intends to stay within the protective space.

This rescue device also comprises lifting means (7) having a structural wire or chain with a cord made of an elastomer material. This lifting means are used in association with a crane or a davit to lift and deploy the rescue device (1) when needed.

In the figure it can be observed how protective panels (3) comprise seating means (8). In a particular embodiment these seating means (8) form an angle greater than 45 degrees with the base (2). The aim is that a person using these seating means is ready for initiating a transfer operation easily. This aim is supported by the position and shape of the string means (4), which allow a person seated in the seating means (8) to exit the rescue device (1) easily and quickly.

Protective panels (3) comprise shock absorbing means suitable for absorbing the energy of an impact mainly due to relative motions of the rescue device and environment, the obstructions within the landing area, but also due to waves or objects contained in the sea. In a particular embodiment, the protective panels (3) comprise buoyancy means.

The outer structure is used to protect passengers in the event of immersion in water, and also acts as shock absorbing means to protect the passengers from lateral impacts.

Protective panels (3) provide an effective positional restraint for the person located in the protective space, thus preventing the hazard associated with dislodging passengers in the event of impact from a wide range of directions and also provide shock absorption to protect passengers from lateral impacts.

Regarding the string elements, its length and the fact that the person housed in the protective space applies loads in a direction which is perpendicular to the elongation direction of the string element makes the string element behave like a soft spring mechanism, allowing a person to flex each string element in turn to reach a position between the string elements and the inner surface of the main body. The overall effect is to secure the passenger effectively, without the need for buckles or other disconnecting mechanisms. The allowed flex of the string elements also allows them to accommodate and provide effective restraint of a wide range of body volumes and heights.

Figure 2:
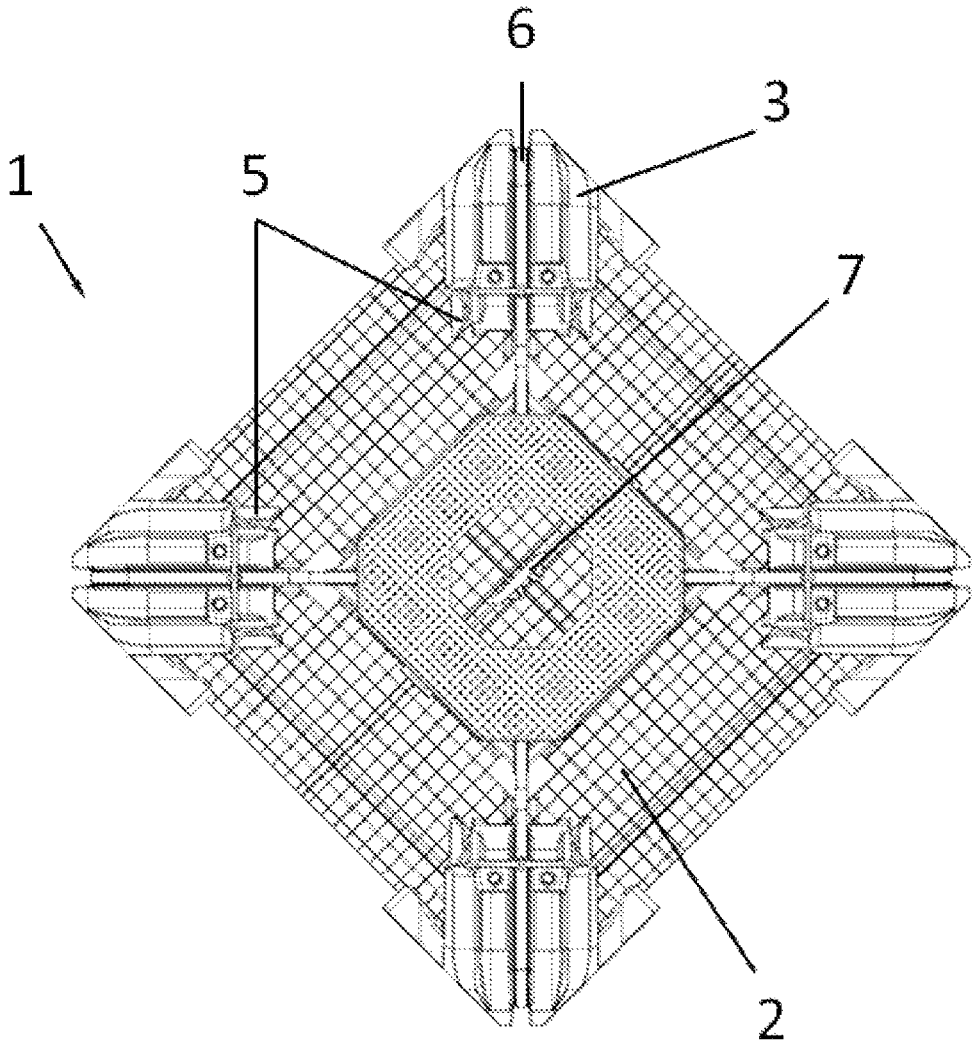
FIG. 2 This figure shows a top view of a first embodiment of a rescue device according to the invention.
Figure 3:
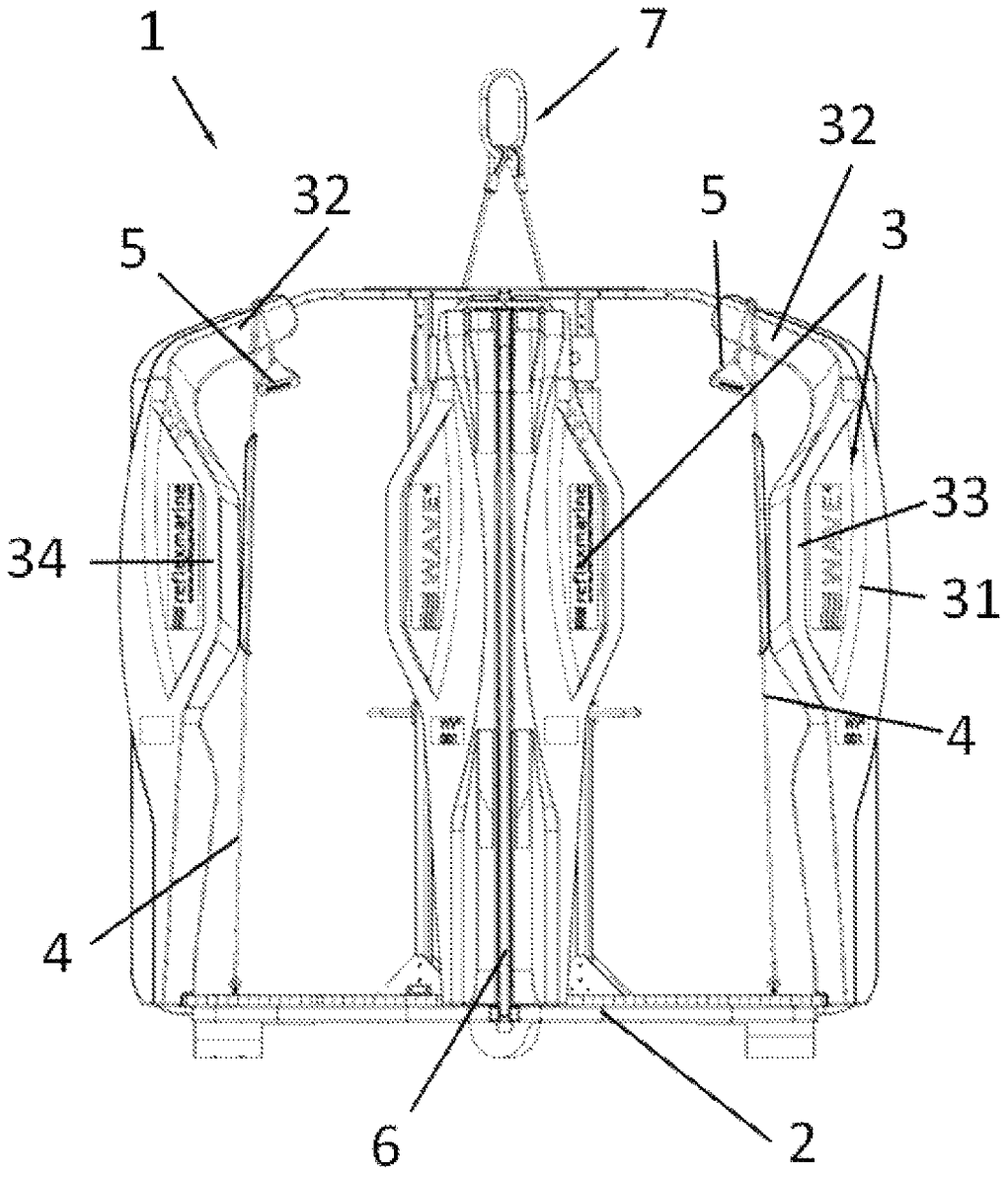
FIG. 3 This figure shows a front view of a first embodiment of a rescue device according to the invention.

FIGS. 2 and 3 show a top view and a front view of the rescue device (1) shown in FIG. 1.

What is claimed is:

1. A rescue device comprising:

a base extending along a first plane, the base surrounding a central axis along which a lifting means is configured to lift the rescue device;

a plurality of protective panels, at least one protective panel having a shell shape with a main body extending perpendicular to the first plane and parallel to the central axis, at least a top protrusion extending from the main body in a first direction toward the central axis to overhang the base and at least one side protrusion extending from the main body in a second direction alongside the base, such that the top protrusion and the side protrusion face toward a common area of the base to form a protective space between the top portion and the base and alongside the side portion, the protective space being suitable for a person to be housed in, such that the main body and the at least one side protrusion are suitable for protecting the protective space from an impact coming from directions parallel to the base, and the top protrusion is suitable for protecting the protective space from an impact coming from a direction perpendicular to the base, wherein the main body and the at least one side protrusion are suitable for protecting the protective space from an impact coming from directions parallel to the base comprised in a range wider than 200°; and hand gripping elements.

2. The rescue device according to claim 1, further comprising a pair of string elements associated to each protective panel each string element being attached to the base and to another point of the rescue device, in such a way that the distance between each string element of the pair of string elements is less than 1 m and the distance between one string element and the associated protective panel is between 10 cm and 60 cm.

3. The rescue device according to claim 2, wherein the pair of string elements are substantially vertical.

4. The rescue device according to claim 1, wherein at least one protective panel comprises buoyancy means.

5. The rescue device according to claim 2, wherein each string element is attached to the base and to a protective panel.

6. The rescue device according to claim 2, wherein string elements are ropes.

7. The rescue device according to claim 2, further comprising an outer structure comprising bars.

8. The rescue device according to claim 7, wherein each string element is attached to the base and to a bar.

9. The rescue device according to claim 1, further comprising lifting means having a structural wire or chain with a cord made of an elastomer material.

10. The rescue device according to claim 1, wherein the base has a polygonal shape.

11. The rescue device according to claim 1, wherein at least one protective panel comprises seating means.

12. The rescue device according to claim 1, wherein at least one protective panel comprises shock absorbing means suitable for absorbing the energy of an impact.

* * * * *